US008922336B2

(12) United States Patent
Takenaka et al.

(10) Patent No.: US 8,922,336 B2
(45) Date of Patent: Dec. 30, 2014

(54) ENTRY/EXIT CONTROL SYSTEM AND METHOD USING SHARED CODES COMBINED WITH USER PERSONAL INFORMATION

(75) Inventors: Kazuaki Takenaka, Tokyo (JP); Takahiko Ohta, Tokyo (JP)

(73) Assignee: Azbil Corporation, Tokyo (JP)

( * ) Notice: Subject to any disclaimer, the term of this patent is extended or adjusted under 35 U.S.C. 154(b) by 436 days.

(21) Appl. No.: 13/237,091

(22) Filed: Sep. 20, 2011

(65) Prior Publication Data

US 2012/0075058 A1 Mar. 29, 2012

(30) Foreign Application Priority Data

Sep. 27, 2010 (JP) ..... 2010-214863

(51) Int. Cl.
*G08B 29/00* (2006.01)
*G07C 9/00* (2006.01)

(52) U.S. Cl.
CPC ..... *G07C 9/00166* (2013.01)
USPC ..... 340/5.6; 235/382; 340/5.5; 340/5.7

(58) Field of Classification Search
USPC ..... 235/375, 380, 382, 382.5; 340/5.2–5.26, 5.5, 5.6–5.67, 5.7–5.73; 455/43; 726/2, 21, 27, 28
See application file for complete search history.

(56) References Cited

U.S. PATENT DOCUMENTS 5,591,950 A * 1/1997 Imedio-Ocana ..... 235/382.5
6,950,944 B2 * 9/2005 Yager et al. ..... 726/1
7,209,029 B2 * 4/2007 Coelho et al. ..... 340/5.26
8,248,206 B2 * 8/2012 Sato et al. ..... 340/5.73
2001/0034623 A1 * 10/2001 Chung ..... 705/5
2002/0031228 A1 * 3/2002 Karkas et al. ..... 380/270

(Continued)

FOREIGN PATENT DOCUMENTS

JP 4-287197 A 10/1992
JP 8-315203 A 11/1996

(Continued)

OTHER PUBLICATIONS

Korean-language Office Action dated (Jul. 18, 2012) for Korean Patent Application No. 10-2011-0071050, which is the corresponding Korean application to the instant U.S. Appl. No. 13/237,091.

(Continued)

*Primary Examiner* — Benjamin C Lee
*Assistant Examiner* — Stephen Burgdorf
(74) *Attorney, Agent, or Firm* — Troutman Sanders LLP

(57) ABSTRACT

An entry/exit controlling system includes a comparison data generating terminal and an entry/exit controlling device. The comparison data generating terminal includes a storing portion storing one or more shared codes shared between visitors as information used in entry/exit authorization evaluations, and a comparison data generating portion generating comparison data including the shared code and personal information of the visitor. The shared code includes an authorization level that indicates regions where the visitors are authorized to enter/exit using the shared code. The entry/exit evaluating portion evaluates entry/exit authorization of the visitor at the region through comparing the shared code included in the comparison data to entry/exit evaluation information stored in the entry/exit controlling device. The comparison data is obtained from a recording medium by a reader disposed at the region. The entry/exit evaluating portion controls entry/exit of the visitor at the region based on a result of the entry/exit authorization evaluation.

7 Claims, 7 Drawing Sheets

(56) References Cited

U.S. PATENT DOCUMENTS

| | | | | |
|---|---|---|---|---|
| 2004/0222877 | A1* | 11/2004 | Teramura et al. | 340/5.65 |
| 2005/0174214 | A1* | 8/2005 | Ocana | 340/5.65 |
| 2006/0049914 | A1* | 3/2006 | Fitzgibbon | 340/5.23 |
| 2007/0267489 | A1* | 11/2007 | Borodulin | 235/382 |
| 2011/0295673 | A1* | 12/2011 | VanNoller et al. | 705/14.26 |

FOREIGN PATENT DOCUMENTS

| | | | |
|---|---|---|---|
| JP | 2005-97976 | A | 4/2005 |
| JP | 2005-149362 | A | 6/2005 |
| JP | 2007-168952 | A | 7/2007 |
| JP | 2009-52279 | A | 3/2009 |
| JP | 2009-098780 | A | 5/2009 |
| KR | 2002-0033139 | | 5/2002 |
| KR | 2007-0001477 | | 1/2007 |

OTHER PUBLICATIONS

Japanese Office Action, dated Feb. 12, 2014, which issued during the prosecution of Japanese Patent Application No. 2010-214863, which corresponds to the present application.

* cited by examiner

FIG. 2
| Shared Codes |
| --- |
| 006002001 |
| 006002002 |
| 006002003 |
| ⋮ |
FIG. 3
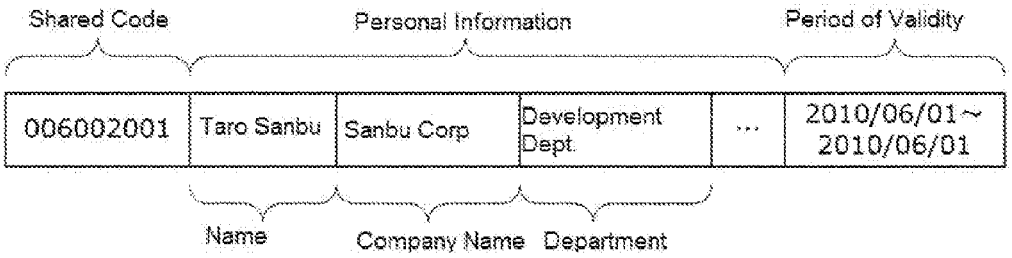
FIG. 4
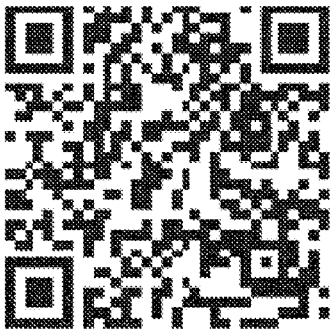

FIG. 5

| Shared Code | Entry/Exit Authorization Information |
|---|---|
| 006002001 | 1 |
| 006002002 | 2 |
| 006002003 | 3 |
| Etc. | |

FIG. 6

| Region | Reader ID | Region Authorization Level |
|---|---|---|
| Meeting Room 1 | 00101 | 1 |
| Meeting Room 2 | 00102 | 1 |
| Conference Room 1 | 00201 | 2 |
| Conference Room 2 | 00202 | 2 |
| Laboratory A | 00301 | 3 |
| Etc. | | |

FIG. 7

| Evaluation Date and Time | Shared Code | Personal Information | Region | Type |
|---|---|---|---|---|
| June 1, 2010, 09:55 | 006002001 | Taro Sanbu,... | Meeting Room 1 | Entered |
| June 1, 2010, 10:08 | 006002001 | Hanako Sanbu,... | Meeting Room 2 | Entered |
| Etc. | | | | |

ENTRY/EXIT CONTROL SYSTEM AND METHOD USING SHARED CODES COMBINED WITH USER PERSONAL INFORMATION

CROSS REFERENCE TO RELATED APPLICATIONS

The present application claims priority under 35 U.S.C. §119 to Japanese Patent Application No. 2010-214863, filed Sep. 27, 2010, which is incorporated herein by reference.

FIELD OF TECHNOLOGY

The present invention relates to an entry/exit controlling technology, and, in particular, relates to an entry/exit controlling technology for evaluating entry/exit regarding a visitor, and for recording a history thereof.

BACKGROUND OF THE INVENTION

Typically, in entry/exit controlling systems for controlling facilities and buildings, if there is the need for security regarding a visitor to a particular region, in receiving the visitor, an ID card is loaned and entry/exit for a particular region is controlled through evaluating entry/exit authorization through referencing entry/exit evaluation information that is stored in advance in a storing portion, based on identification information read from that ID card by a reader. Moreover, for each entry/exit evaluation process, the processing date and time, the user identification information, as well as the evaluation result, and the like, are stored as historical information in order to investigate on a later date, if necessary, the visitors that have entered/exited the particular region, and the regions entered by particular visitors.

In this type of entry/exit controlling system, it is necessary to record various types of information, such as personal information for the visitor, the specific regions into which the visitor is permitted, and the like, in order to perform control, with the ID card and the visitor tied together when the ID card is loaned to the visitor at the time of a visit. Because of this, the registration operations at the time of loaning an ID card are time-consuming, making the visitor wait. Moreover, this is true not just for the operations at the time of reception; there is also the need for operations to undo the relationships when the ID card is returned and the need for control operations when an ID card is not returned or is damaged, which are factors that increase the operating costs required in ID card control for visitors.

Conventionally, in entry/exit control systems, there have been proposals for technologies wherein the visitor is issued a security code, instead of an ID card, wherein passage is controlled based on the result of a comparison of the security code inputted in an operation by the visitor at the time of entering or exiting a specific region, and based on use control information corresponding to that security code (See, for example, Japanese Unexamined Patent Application Publication 2005-097976).

Moreover, there have been proposals for technologies wherein this type of security code, or the like, is used as an identification code for identifying the visitor, to reduce the operating overhead at the time of entry/exit through the use of an identification code that is read from a barcode, or an identification code obtained through near field communication with a mobile terminal (See, for example, Japanese Unexamined Patent Application Publication 2007-168952).

Given such conventional technology, it is possible to perform entry/exit evaluations based on identification codes that are assigned to individual users, thus eliminating the need for ID cards to be loaned to the users, and making it possible to reduce the operating costs required in controlling the ID cards.

However, in the conventional technology, merely recording, as historical information, the identification codes obtained at the time of the entry/exit evaluations does not enable the identification of the visitors from the identification codes on later dates, requiring there to be control by which to tie together the 1-to-1 relationships between the identification codes and the visitors. Because of this, in order to avoid redundancies in identification codes that are issued, it is necessary to have centralized control of the state wherein identification codes are issued throughout the entry/exit controlling system as a whole, and thus there has been a problem in that this does not reduce the cost of control in regards to the identification codes.

The present invention is to solve this type of problem, and the object thereof is to provide an entry/exit controlling technology able to reduce greatly the cost of control in regards to codes for identifying visitors, even in the case of recording historical information.

SUMMARY OF THE INVENTION

In order to achieve such an object, the entry/exit controlling system according to the present invention includes a comparison data generating terminal having a storing portion for storing in advance one or more shared codes shared between a plurality of visitors as information used in entry/exit authorization evaluations, and a comparison data generating portion for generating comparison data, including one of the shared codes and personal information of the visitor, required when a visitor enters/exits a region wherein entry/exit is controlled; a storing portion for storing in advance entry/exit evaluation information wherein is recorded entry/exit-authorized regions for each individual shared code; and an entry/exit evaluating portion for controlling entry/exit of the visitor at the region based on an evaluation result of an entry/exit authorization evaluation, by evaluating entry/exit authorization of the visitor at the region through comparing, to the entry/exit evaluation information, the shared code included in the comparison data obtained, by a reader that is disposed at the region, from a recording medium upon which is recorded the comparison data of the visitor; and a history storing portion for recording, to a storing portion, as historical information pertaining to entry/exit authorization evaluations, processing details of the entry/exit authorization evaluation and the personal information that is included in the comparison data.

At this time, when comparison data is generated by the comparison data generating portion, a period of validity of the comparison data may be added to the comparison data, and at the time of the entrance authorization evaluation in the entrance evaluating portion, and the validity of the comparison data may be confirmed based on the period of validity included in the comparison data.

Moreover, when comparison data is generated by the comparison data generating portion, an arbitrary security code may be added to the comparison data, and at the time of the entrance authorization evaluation in the entrance evaluating portion, and the match between a security code inputted through operations at a reader and the security code included in the comparison data may be checked.

Additionally, in the comparison data generating portion, a portion or all of the comparison data may be encrypted, and, in the entry/exit evaluating portion, the portion or all of the comparison data that is encrypted may be decrypted.

Moreover, the comparison data generating portion may send the generated comparison data via electronic mail to a mobile terminal of a visitor, which is a recording medium, and comparison data that has been sent via electronic mail and that is displayed on a screen by the mobile terminal, or comparison data that has been sent from a mobile terminal through near field communication, may be read in by a reader.

Moreover, comparison data that is printed out on a recording medium may be obtained by a reader.

Moreover, an entry/exit controlling method as set forth in the present invention has a storing step wherein a comparison data generating terminal stores, in advance, one or more shared codes shared between a plurality of visitors as information used in entry/exit authorization evaluations; a comparison data generating step wherein a comparison data generating portion of the comparison data generating terminal generates comparison data, including one of the shared codes and personal information of the visitor, required when a visitor enters/exits a region wherein entry/exit is controlled; a storing step wherein a storing portion of the entry/exit controlling device stores, in advance, entry/exit evaluation information wherein is recorded entry/exit-authorized regions for each individual shared code; an entry/exit evaluating step wherein an entry/exit evaluating portion of the entrance/exit controlling device controls entry/exit of the visitor at the region based on an evaluation result of an entry/exit authorization evaluation, by evaluating entry/exit authorization of the visitor at the region through comparing, to the entry/exit evaluation information, the shared code included in the comparison data obtained, by a reader that is disposed at the region, from a recording medium upon which is recorded the comparison data of the visitor; and the history controlling step wherein a history storing portion of the entry/exit controlling device records, to a storing portion, as historical information pertaining to entry/exit authorization evaluations, processing details of the entry/exit authorization evaluation and the personal information that is included in the comparison data.

Given the present invention, it is possible to specify easily, on a later date, historical information regarding a visitor, without using an identification code that can specify the visitor, because the personal information of the visitor that is included in the comparison data is stored as historical information. Consequently, it is possible to use shared codes, which are shared among a plurality of visitors, as identification codes for performing entry/exit evaluations for the visitors.

Merely associating the shared codes in advance with the regions wherein entry/exit is permitted, through entry/exit evaluation information, enables sharing of the shared codes between a plurality of visitors, without establishing associations with the visitors, and thus there is no need to control the state of use for the individual shared codes.

Because of this, it is possible to reduce substantially the cost of control that has been required with conventional identification codes, such as for controlling the state of use of each individual identification code by creating 1-to-1 relationships between identification codes and visitors, selecting and assigning, from among identification codes corresponding to regions for which entry/exit is permitted by the visitor, identification codes that are in an unused state, putting the identification code into an unused state at the conclusion of a visit, and the like.

BRIEF DESCRIPTION OF THE DRAWINGS

FIG. 2 is a structural example of a shared code.

FIG. 3 is a structural example of comparison data.

FIG. 4 is an alternate example of a QR code.

FIG. 5 is a structural example of entry/exit evaluation information.

FIG. 6 is a structural example of region information.

FIG. 7 is a structural example of history information.

DETAILED DESCRIPTION OF THE INVENTION

Forms for carrying out the present invention will be explained next in reference to the figures.

Figure 1:
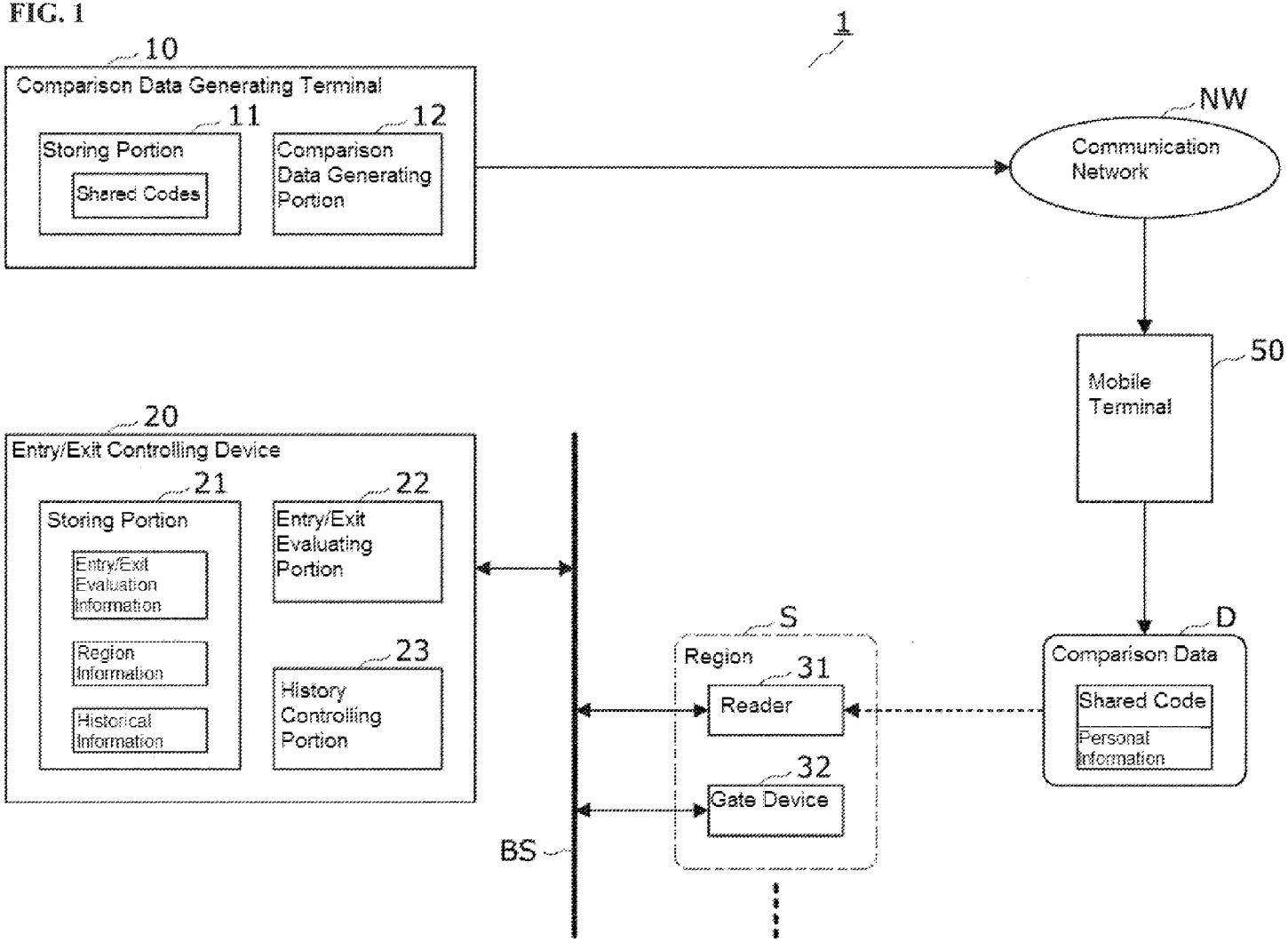
FIG. 1 is a block diagram illustrating a structure of an entry/exit controlling system according to an example.

First of all, an entry/exit controlling system according to an example is explained in reference to FIG. 1. FIG. 1 is a block diagram illustrating a structure of an entry/exit controlling system according to an example.

This entry/exit controlling system 1 is a system for controlling entry/exit by a visitor for each region provided within a facility or building, and includes, as its primary structures, a comparison data generating terminal 10, an entry/exit controlling device 20, a reader 31, and a gate device 32.

The reader 31 and gate device 32, which are provided at each entry/exit of each region S, are connected to an entry/exit controlling device 30 so as to be able to exchange data with each other through a control bus BS. Moreover, the comparison data generating terminal 10 and the entry/exit controlling device 20, although provided independently from each other, may also be connected through a communication circuit so as to enable data communication.

In the present example, one or more shared codes, which are shared among a plurality of visitors, are stored in advance as information to be used in entry/exit authorization evaluations, and comparison data, including one of the shared codes and personal information of the visitor, required when the visitor enters/exit at a region wherein entry/exit is controlled, is generated by the comparison data generating terminal 10, and, in the entry/exit controlling device 20, entry/exit by a visitor at a region is controlled based on evaluation results of entry/exit authorization evaluation by evaluating the entry/exit authorization of the visitor at that region through comparing the entry/exit evaluation information and the shared code that is included in the comparison data obtained from a reader that is disposed at that region, from a recording medium whereon the comparison data for the visitor is recorded, and a storing portion whereon is stored, in advance, entry/exit evaluation information wherein is stored entry/exit-authorized regions for each shared code, where the detail of the entry/exit authorization evaluation process and the personal information included in the comparison data are recorded to the storing portion as historical information regarding the entry/exit authorization evaluation.

The reader 31 has a function for obtaining comparison data D used in the entry/exit authorization evaluation from a recording medium such as a mobile terminal 50 held by the visitor. In particular, a reader 31 may be used that has a scanner function that can read a symbol optically from a screen that displays the symbol or from a paper label upon which the symbol is printed, when a symbol wherein data is encoded and displayed graphically, such as with a QR code, is used as the comparison data D. Moreover, when the comparison data D is obtained through data communication from the mobile terminal 50, a reader 31 may be used that has near field communication functions such as infrared communications or RFID.

The gate device 32 is provided at an entry/exit of a region S, and has a function for opening a gate of the entry/exit, or unlocking an electric lock of the gate, in response to an open-gate instruction from the entry/exit controlling device 20. This gate device 32 normally prohibits entry/exit of the visitor through maintaining a state wherein the gate is closed or the lock is locked, and opens the gate or unlocks the lock over only a specific time interval when an open-gate instruction has been received from the entry/exit controlling device 20.

The mobile terminal 50 is an information communication terminal such as an ordinary mobile telephone or PDA, and has a function for receiving electronic mail through a communication network NW from the comparison data generating terminal 10. In particular, when a symbol wherein data is encoded and displayed graphically, as in a QR code, is used as the comparison data D, a mobile terminal 50 that has a function for displaying on a screen a symbol that has been sent via electronic mail may be used. Moreover, a mobile terminal 50 that has a near field communication function, such as infrared communication or RFID, may be used when communicating the comparison data D to the reader 31 through data communication.

The comparison data generating terminal 10 in the entry/exit controlling system 1 according to the present example is explained next in reference to FIG. 1. An example of a case wherein a QR code is used as comparison data will be explained in the present example.

The comparison data generating terminal 10 is, overall, a data processing terminal such as a personal computer, and has, as its functional portions a storing portion 11 and a comparison data generating portion 12. The comparison data generating terminal 10 also has an operation inputting portion such as a keyboard or a mouse, a screen displaying device such as an LCD, a data communication portion that is used when sending or receiving electronic mail, and the various functions that are ordinarily provided in a data processing terminal.

The storing portion 11 is made from a storage device, such as a hard disk or semiconductor memory, and has the function of storing the various types of process information and programs used in the processing operations in the comparison data generating terminal 10.

The main processing information stored in the storing portion 11 includes the shared codes. FIG. 2 is a structural example of a shared code. A plurality of shared codes, each structured from nine-digit numbers, is stored here. Each shared code has an authorization level, which indicates the entry/exit-authorized regions wherein entry/exit is authorized by the shared code, set in advance in the entrance evaluation information of the entry/exit controlling device 20, described below. When generating comparison data for an arbitrary visitor, a shared code corresponding to the regions wherein that visitor is permitted is selected.

A comparison data generating portion 12 includes a calculation processing portion for performing a variety of processes through executing, on a CPU, programs of the storing portion 11, and has the function of generating comparison data that is required when the visitor enters/exits a region for which entry/exit is controlled, and which includes one of the shared codes of the storing portion 11 along with personal information of the visitor, has a function for encrypting a part or all of the comparison data that has been generated, has a function for converting the encrypted data into a QR code, and has a function for sending, using electronic mail, the comparison data, which has the QR code that has been obtained, to the mobile terminal 50 of the visitor.

FIG. 3 is a structural example of comparison data. It includes the shared code, the personal information of the visitor that includes the name and company name of the visitor, the address thereof, and the like, and a period of validity that indicates the period over which the comparison data is valid. Of these, the shared code is a shared code corresponding to the regions that the visitor will enter/exit, selected by an operator from the storing portion 11. The personal information is personal information for the visitor, obtained in advance, and inputted by an operator. The period of validity is inputted by an operator to match the period of the visit by the visitor.

FIG. 4 is an example of a QR code conversion. Here an example is shown wherein the comparison data illustrated in FIG. 3 has been converted into a QR code. Note that if there is the need for security regarding the personal information, or the like, the conversion into the QR code may be performed after encryption of that portion. Because the QR code is produced as a graphical file, the graphical file of the QR code may be sent in electronic mail to the visitor in the form of an attachment. Note that the comparison data may be converted into another symbol, such as, for example, a one-dimensional barcode or color barcode, instead of a QR code.

The entry/exit controlling device 20 of the entry/exit controlling system 1 according to the present example is explained in detail next, referencing FIG. 1. An example of a case wherein a QR code is used as comparison data is explained in the present example. Overall, the entry/exit controlling device 20 is made from an equipment controlling device, such as a controller, for controlling, using a computer, various types of equipment connected to a control bus BS, and is connected to readers 31 and gate devices 32 of the various regions S through the control bus BS so as to enable data communications. This entry/exit controlling device 20 comprises, as its primary functional portions: a storing portion 21; an entry/exit evaluating portion 22, and a history controlling portion 23.

This storing portion 21 is made from a storing device such as a hard disk or a semiconductor memory, and has a function for storing various types of processing information and programs used in processing operations in the entry/exit controlling device 20.

The storing portion 21 has, as its primary processing information, entry/exit evaluation information, region information, and historical information.

FIG. 5 is an example of a structure for entry/exit evaluation information. The entry/exit evaluation information is information indicating regions that can be entered/exited using shared codes. Here authorization levels are stored, for each individual shared code, as entry/exit information indicating the regions that can be entered/exited by the shared code. For example, for the shared code "006002001," an authorization level of "1" that authorizes entry/exit of a meeting room is stored, and for the shared code "006002002," an authorization level of "2" that authorizes entry/exit of a meeting room is stored.

This authorization level is information indicating the entry/exit authorization priority, not only authorizing entry/exit of a region having an authorization level equal to that level value, but also authorizing entry/exit of regions having authorization levels lower than that level value. Consequently, a visitor that is assigned the shared code "006002002" is authorized for entry/exit of regions not only of authorization level "2," but also of authorization level "1".

FIG. 6 is a structural example of region information. The region information is information indicating the readers that are disposed at regions controlled by the entry/exit controlling system, and region authorization levels for which entry/exit is authorized for those regions. Here reader IDs, for identifying readers 31 that are disposed at the entrances/exits of the regions, for identifying those regions, and region authorization levels for which entry/exit is authorized for those regions, are recorded as combinations for each individual region. For example, a region known as "Meeting Room 1" is provided with a reader 31 having a reader ID "00101," and is recorded with the region authorization level for which entry/exit of the "Meeting Room 1" is authorized being authorization level "1".

FIG. 7 is a structural diagram of historical information. Here the evaluation date and time, the shared code, the personal information, the region, and the type is recorded for each entry/exit evaluation process performed by the entry/exit evaluating portion 22 of the entry/exit controlling device 20. Of this, the evaluation date and time indicates the date and time at which the entry/exit evaluation was performed. In addition, the shared code and personal information are the shared code and personal information obtained from the comparison data in the entry/exit evaluating process. The region indicates the region that was subject to the entry/exit evaluation, and the type indicates the category, that is, Entered/Exited/Error, that was the result of the entry/exit evaluating process.

In FIG. 7, for example a visitor "Taro Sanbu," to whom is assigned the shared code "0060020001" is recorded as "Entered" into "Meeting Room 1" at "2010, Jun. 6-01 09:55". Additionally, a visitor "Hanako Sanbu," to whom is assigned the same shared code as above "0060020001" is recorded as "Entered" into "Meeting Room 2" at "2010, Jun. 1 10:08". In this case, although identical shared codes were used in the entry/exit authorization evaluations for different visitors, personal information for each individual visitor is included in the historical information, making it possible to differentiate the historical information.

The entry/exit evaluating portion 22 is made from a calculation processing portion for performing various types of processes through executing, on a CPU, programs from the storing portion 11, and has a function or receive an evaluation request from a reader through a control bus BS, a function for decoding the encrypted part or all of comparison data that is included in an evaluation request that has been received, a function for evaluating the entry/exit authorization of a visitor in a region through comparing the shared code included in the comparison data that has been obtained, and a function for controlling the entry/exit of the visitor at the region based on the evaluation result of the entry/exit authorization evaluation.

As specific functions for the entry/exit evaluating portion 22, there is: a function for obtaining a shared code that is included in the comparison data that has been reported in the evaluation request; a function for obtaining entry/exit authorization information corresponding to the shared code, from the entry/exit evaluation information of the storing portion 21; a function for obtaining the reader ID of the reader 31 reported in the evaluation request; a function for obtaining a region authorization level corresponding to the reader ID, from the region information of the storing portion 21; and a function for evaluating whether or not entry/exit is authorized at the region, through comparing the authorization level of the entry/exit authorization information and the region authorization level.

The history controlling portion 23 is made from a calculation processing portion for performing various types of processes through executing, on a CPU, programs of the storing portion 11, and has a function for recording into the storing portion 21 the processing detail of the entry/exit authorization evaluations of the entry/exit evaluating portion 22, along with the personal information that is included in the comparison data, as historical information pertaining to the entry/exit authorization evaluation. As the entry/exit authorization evaluation processing details there are the various types of information such as the evaluation date and time, the shared code, the region, the type, and the like, explained for the historical information in FIG. 7.

Figure 8:
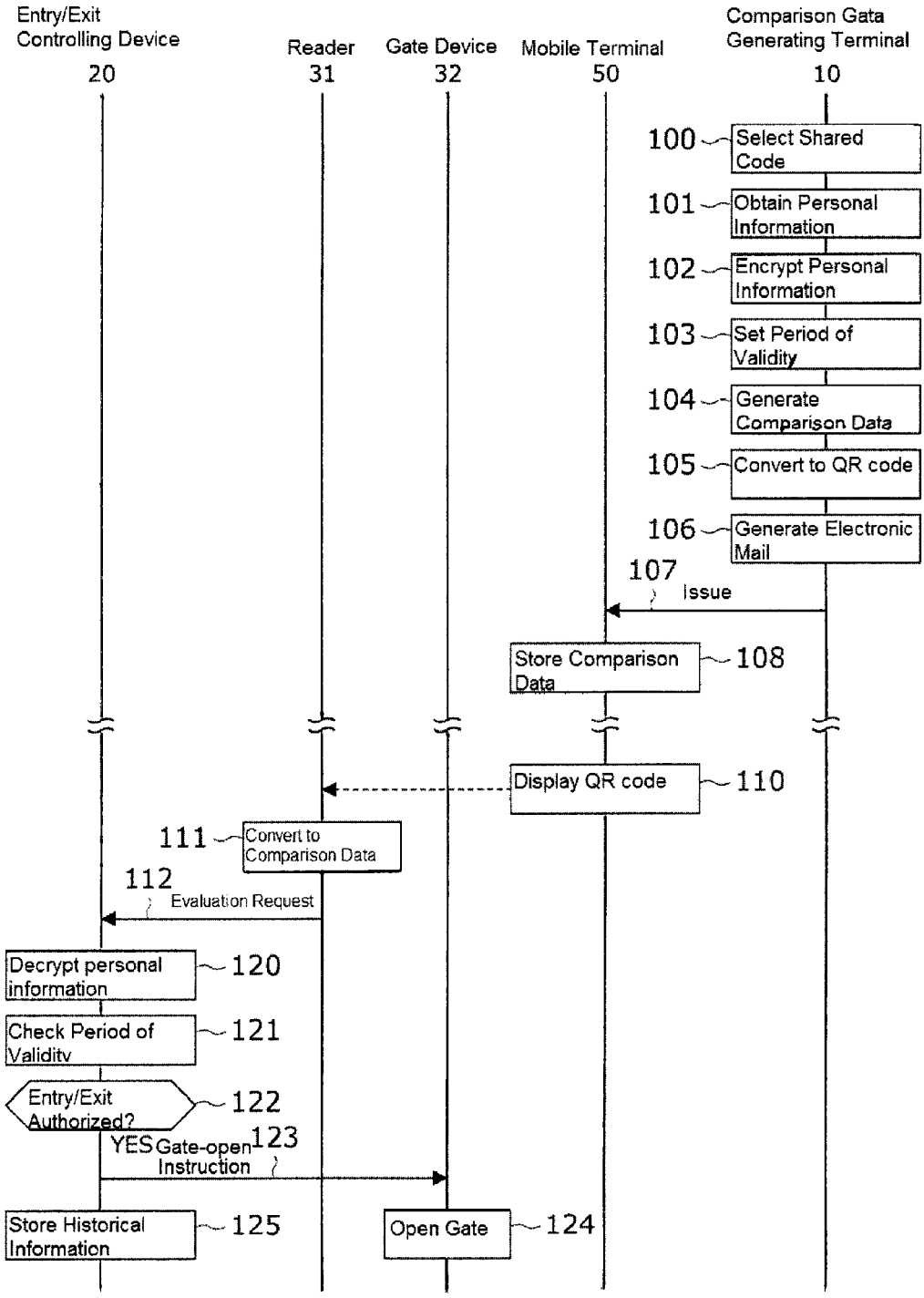
FIG. 8 is a sequence diagram illustrating the operation of an entry/exit controlling system according to the example.

FIG. 8 will be referenced next to explain the operation of the entry/exit controlling system according to the present form of embodiment. FIG. 8 is a sequence diagram illustrating the operation of an entry/exit controlling system according to an example.

Here a case is explained wherein the operator who is to be visited by a visitor uses a comparison data generating terminal 10 to generate, as a QR code, comparison data for the visitor, and sends it in advance to a mobile terminal 50 of the visitor via electronic mail, and, at the time of the visit, the visitor operates the mobile terminal 50 to display the QR code on a screen thereof to present it to a reader 31 that is disposed at the entry/exit of a meeting room that is a region S, to request entry/exit authorization. First, at the comparison data generating terminal 10, the comparison data generating portion 12, in response to an operation by an operator, selects, from shared codes that are stored in the storing portion 11, a shared code indicating entry/exit authorization for the regions S to be entered/exited by the visitor (Step 100).

Additionally, the comparison data generating portion 12, in response to an operation by the user, obtains personal information of the visitor (Step 101), and encrypts the personal information (Step 102), and, in response to an operation by the user, sets a period of validity of the comparison data that has been generated (Step 103).

Following this, the comparison data generating portion 12 uses the shared code, the encrypted personal information, and the period of validity to generate the comparison data illustrated in FIG. 3, described above (Step 104), and converts the comparison data into the QR code illustrated in FIG. 4, described above (Step 105).

Next, the comparison data generating portion 12, in response to an operation by the user, obtains a document including the electronic mail address of the mobile terminal 50 of the visitor, the date and time of the visit, and the like, generates electronic mail to which is attached a graphic file representing the QR code (Step 106), and issues the comparison data to the visitor through a transmission to the mobile terminal 50 through a communication network NW (Step 107).

The mobile terminal 50 receives the electronic mail through the communication network NW from the comparison data generating terminal 10, and stores, in memory, the comparison data comprising the QR code that was attached to the electronic mail (Step 108).

Thereafter, when the visitor visits and requests authorization to enter the meeting room, the mobile terminal 50, in response to an operation by the visitor, displays the QR code on the screen thereof (Step 110).

The reader 31 that is provided at the entry/exit of the region S that is the meeting room converts the QR code that is displayed on the screen of the mobile terminal 50 into comparison data (Step 111), and sends an evaluation request, which includes the comparison data and the local reader ID, to the entry/exit controlling device 20 through the control bus BS (Step 112).

The entry/exit evaluating portion 22 of the entry/exit controlling device 20, in response to the evaluation request from the reader 31, decrypts the encrypted personal information in the comparison data reported in the evaluation request (Step 120) and checks the validity of the comparison data by obtaining the period of validity that is included within the comparison data that has been obtained and comparing to the current date and time (Step 121).

If, at this point, the current date and time is outside of the period of validity so that the validity of the comparison data cannot be confirmed, the entry/exit evaluating portion 22 reports an evaluation error to the reader 31, and, in response, the reader 31 executes an error process, such as displaying an entry/exit denial.

On the other hand, if the current date and time is within the period of validity so that the validity of the comparison data is confirmed, the entry/exit evaluating portion 22 not only obtains, from the entry/exit evaluation information of the storing portion 21, entry/exit authorization information corresponding to the shared code obtained from the comparison data, but also obtains, from the region information of the storing portion 21, the region authorization level corresponding to the reader ID of the reader 31 that was reported in the evaluation request, to evaluate the entry/exit authorization, for the region, through comparing the region authorization level and the authorization level of the entry/exit authorization information that have been obtained (Step 122).

If, at this point, the level value of the authorization level of the entry/exit authorization information is lower than the level value of the region authorization level so that the evaluation is an entry/exit denial, the entry/exit evaluating portion 22 reports an evaluation error to the reader 31, and, in response, the reader 31 executes an error process, such as displaying an entry/exit denial.

On the other hand, if the level value of the authorization level of the entry/exit authorization information is equal to or greater than the level value of the region authorization level so that the evaluation is that entry/exit is authorized (Step 102: YES), the entry/exit evaluating portion 22 sends a gate-open instruction to the gate device 32 of the region S through the control bus BS (Step 123). In response, the gate device 32 opens the gate that is provided at the entry/exit of the region S (Step 124). This makes it possible for the visitor to enter into the meeting room that is the region S.

Thereafter, the history controlling portion 23 obtains, from the entry/exit evaluating portion 22, the personal information of the visitor, which is included in the comparison data, along with the processing detail used in the entry/exit evaluation, indicating the evaluation date and time, the shared code, the region, and the type, and stores these as historical information in the storing portion 21 (Step 125).

In this way, in the present example, comparison data that is required when a visitor enters/exits a region for which entry/exit is controlled, which includes one of the shared codes that are shared between visitors and includes personal information for the visitor, is generated by a comparison data generating portion 12 of a comparison data generating terminal 10. Moreover, an evaluation of whether or not the visitor at the region is authorized to enter/exit is performed by an entry/exit evaluating portion 22 of the entry/exit controlling device 20 through comparing, to entry/exit evaluation information, the shared code that is included in the comparison data that is obtained, by the reader that is disposed at the region, from a storage medium whereon is stored comparison data for the visitor, to thereby control the entry/exit of the visitor at the region based on the comparison result in this entry/exit authorization evaluation, and the processing detail of the entry/exit authorization evaluation and the personal information that is included in the comparison data are stored, by the history controlling portion, into the storing portion 21 as historical information pertaining to the entry/exit authorization evaluation.

Given this, it is possible to specify easily, on a later date, historical information regarding a visitor, without using an identification code that can specify the visitor, because the personal information of the visitor that is included in the comparison data is stored as historical information. Consequently, it is possible to use shared codes, which are shared among a plurality of visitors, as identification codes for performing entry/exit evaluations for the visitors.

Merely associating the shared codes in advance with the regions wherein entry/exit is permitted, through entry/exit evaluation information, enables sharing of the shared codes between a plurality of visitors, without establishing associations with the visitors, and thus there is no need to control the state of use for the individual shared codes. Because of this, it is possible to reduce substantially the cost of control that has been required with conventional identification codes, such as for controlling the state of use of each individual identification code by creating 1-to-1 relationships between identification codes and visitors, selecting and assigning, from among identification codes corresponding to regions for which entry/exit is permitted by the visitor, identification codes that are in an unused state, putting the identification code into an unused state at the conclusion of a visit, and the like.

Additionally, in the present example, when the comparison data is generated in the comparison data generating portion 12, a period of validity of the comparison data is added to the comparison data, and in the entry/exit evaluating portion 22, the entry/exit authorization is evaluated after checking the validity of the comparison data based on the period of validity that is included in the comparison data, thus making it possible to prevent improper use of the comparison data.

Additionally, in the present example, a portion or all of the comparison data is encrypted by the comparison data generating portion 12, and the encrypted portion or all of the comparison data is decrypted by the entry/exit evaluating portion 22, and thus even if the comparison data is obtained improperly by a third-party, it is still possible to prevent leakage of confidential information, such as the personal information of the visitor. Note that that which is encrypted is not limited to the personal information, but the shared code and the period of validity may be encrypted as well. Doing so makes it possible to prevent improper use of the comparison data.

Additionally, in the present example the comparison data that is generated by the comparison data generating portion 12 is sent via electronic mail to a mobile terminal 50 of the visitor, which is a recording medium, and the comparison data that that has been sent by electronic mail and that is displayed on the screen of the mobile terminal 50, or comparison data that is sent via near field communication from the mobile terminal 50, is obtained by the reader 31, thus making it possible to provide, to the reader 31, the comparison data that is required in the entry/exit evaluation through simply operating the mobile terminal 50. This makes it possible to reduce substantially the operating overhead on the visitor at the time of the entry/exit evaluation.

Note that while, in the present example, the explanation was for a case wherein the comparison data was sent to the mobile terminal 50 of the visitor via electronic mail and then was provided to the reader 31 through displaying on the screen of the mobile terminal 50, the method by which the comparison data is provided to the reader 31 is not limited thereto.

Figure 9:
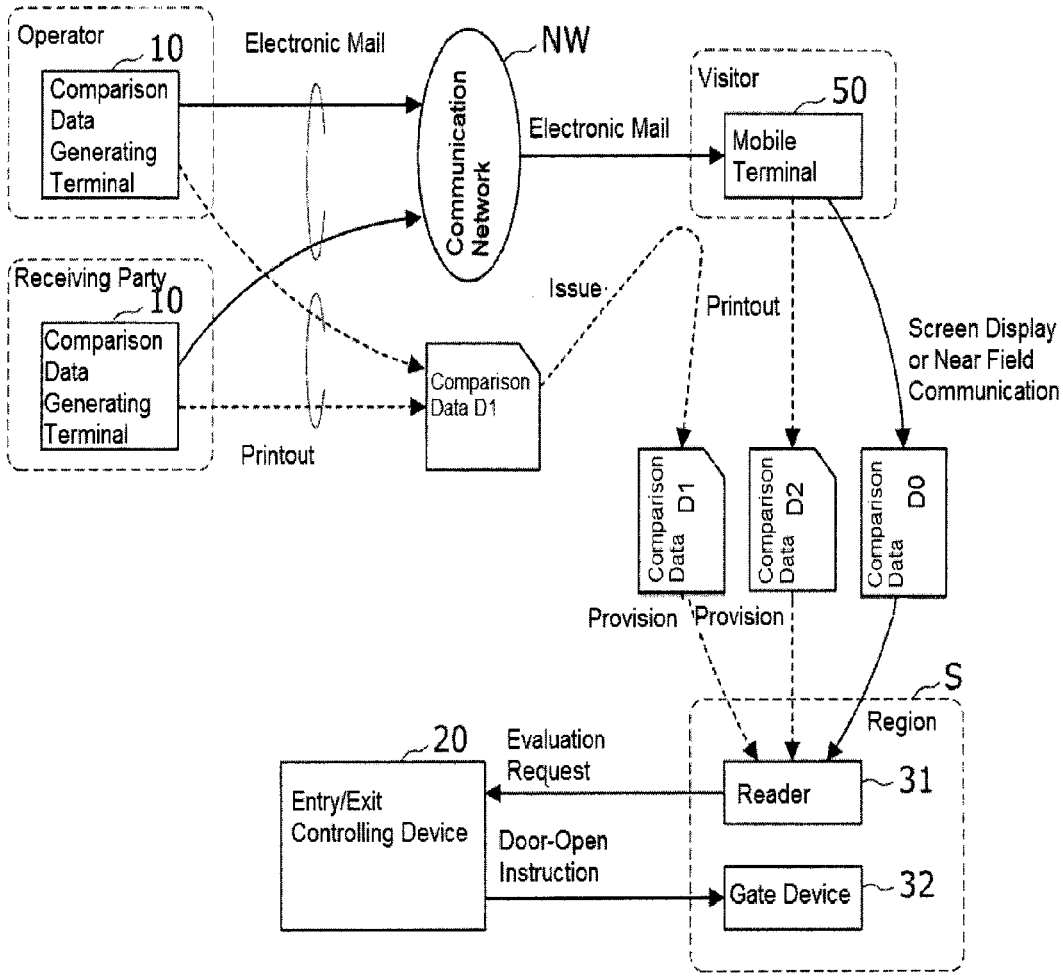
FIG. 9 is an explanatory diagram illustrating the flow of comparison data.

FIG. 9 is an explanatory diagram illustrating the flow of comparison data. The flow of the comparison data explained in the present example follows a route wherein the comparison data generated by the comparison data generating terminal 10 by the operator is sent to the mobile terminal 50 of the visitor through a communication network NW via electronic mail, and comparison data DO that is displayed on the screen of the mobile terminal 50 is read in by the reader 31 at the time of the entry/exit evaluation. At this time, there is, instead of the screen display, a route wherein the comparison data DO is sent to the reader 31 from the mobile terminal 50 through near field communication.

Additionally, the comparison data generation is not limited to being by an operator, but rather may instead be generated by another user, such as the receiving party who can meet with the visitor. For example, at the time of the visit by the visitor, the receiving party may generate the comparison data through the comparison data generating terminal 10 based on a business card presented by the visitor, and then may send it to the mobile terminal 50 of the visitor. Doing so makes it possible to prevent operating overhead on an operator.

Additionally, the comparison data may also be printed out on a recording medium such as a paper label to enable reading by the reader 31. In this case, the comparison data D1 that has been printed out by the comparison data generating terminal 10 may be sent to the visitor, or comparison data D2, wherein electronic mail that has been received by the visitor the through a mobile terminal 50 and printed, out may also be used.

Additionally, while in the present example the explanation was for a case wherein historical information was recorded by the entry/exit controlling device 20, there is no limitation thereto, and instead a history controlling device that is separate from the entry/exit controlling device 20 may be provided, and historical information that is reported by the entry/exit controlling device 20 may be stored sequentially.

An entry/exit controlling system according to another example is explained next.

In the example above, the explanation was for a case wherein a period of validity was established in order to prevent the improper use of the comparison data. In the present example, the explanation will be for a case wherein improper use of the comparison data is prevented through the use of a security number.

In the present example, the comparison data generating portion 12 of the comparison data generating terminal 10 has a function for adding, to the comparison data, an arbitrary security number at the time at which the comparison data is generated.

The entry/exit evaluating portion 22 of the entry/exit controlling device 20 has a function for confirming the match between a security number inputted through an operation at the reader 31 and the security number included in the comparison code at the time of an entry/exit authorization evaluation.

Figure 10:
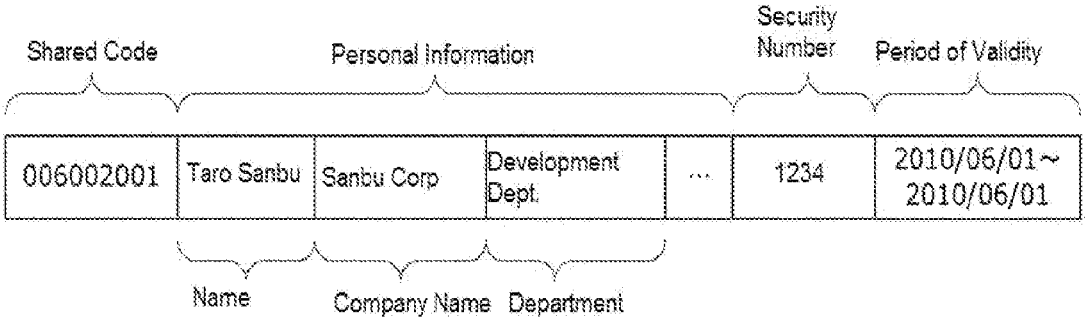
FIG. 10 is another structural example of comparison data.

FIG. 10 is another structural example of comparison data. Here a security number may be added also in addition to the shared code, the personal information, and the period of validity explained above in FIG. 3. This security number may be produced randomly by the comparison data generating portion 12, or may be an arbitrary number inputted through an operation by the operator.

The other structures of the entry/exit controlling system according to the present example are identical to those in the above example, and thus detailed explanations thereof are omitted.

Figure 11:
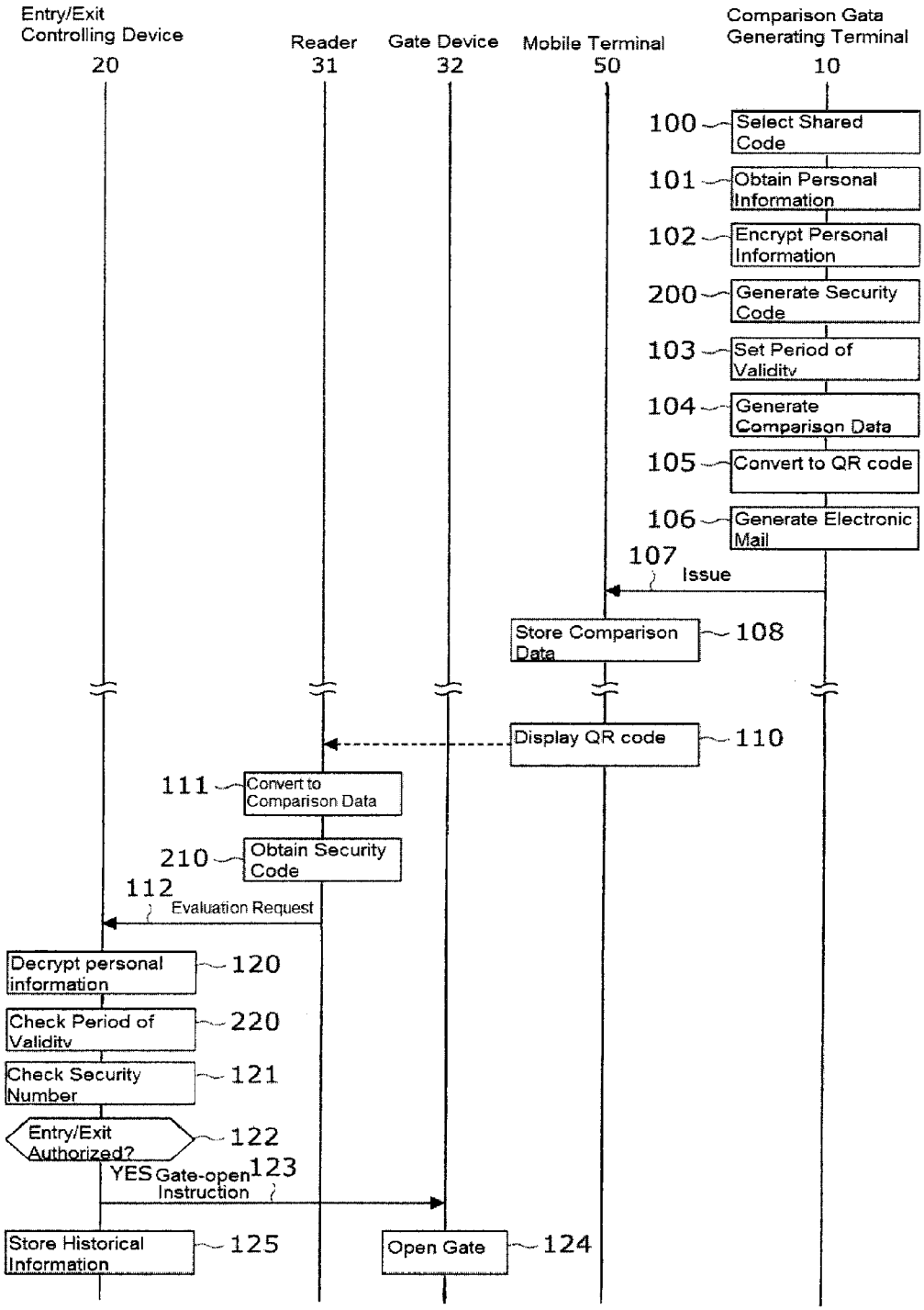
FIG. 11 is a sequence diagram illustrating the operation of an entry/exit controlling system according to another example.

FIG. 11 will be referenced next to explain the operation of the entry/exit controlling system according to the present example. FIG. 11 is a sequence diagram illustrating the operation of the entry/exit controlling system according to the other example, and parts that are identical or equivalent to those in FIG. 8, described above, are assigned identical codes.

Here a case is explained wherein the operator who is to be visited by a visitor uses a comparison data generating terminal 10 to generate, as a QR code, comparison data that includes a security number, and sends it in advance to a mobile terminal 50 of the visitor via electronic mail, and, at the time of the visit, the visitor operates the mobile terminal 50 to display the QR code on a screen thereof to present it to a reader 31 that is disposed at the entry/exit of a meeting room that is a region S, and to input the security number, to request entry/exit authorization.

First, at the comparison data generating terminal 10, the comparison data generating portion 12, in response to an operation by an operator, selects, from shared codes that are stored in the storing portion 11, a shared code indicating entry/exit authorization for the regions S to be entered/exited by the visitor (Step 100).

Additionally, the comparison data generating portion 12, in response to an operation by the user, obtains personal information of the visitor (Step 101), and encrypts the personal information (Step 102), generates a security number (Step 200) and, in response to an operation by the user, sets a period of validity of the comparison data that has been generated (Step 103).

Following this, the comparison data generating portion 12 uses the shared code, the encrypted personal information, the security number, and the period of validity to generate the comparison data illustrated in FIG. 3, described above (Step 104), and converts the comparison data into the QR code illustrated in FIG. 4, described above (Step 105).

Next, the comparison data generating portion 12, in response to an operation by the user, obtains a document including the electronic mail address of the mobile terminal 50 of the visitor, the date and time of the visit, and the like, generates electronic mail to which is attached a graphic file representing the QR code (Step 106), and issues the comparison data to the visitor through a transmission to the mobile terminal 50 through a communication network NW (Step 107).

Thereafter, when the visitor visits and requests authorization to enter the meeting room, the mobile terminal 50, in response to an operation by the visitor, displays the QR code on the screen thereof (Step 110).

The reader 31 that is provided at the entry/exit of the region S that is the meeting room converts the QR code that is displayed on the screen of the mobile terminal 50 into comparison data (Step 111), obtains a security number in response to an operation by the visitor (Step 210), and sends an evaluation request, which includes the comparison data, the security number, and the local reader ID, to the entry/exit controlling device 20 through the control bus BS (Step 112). At this time, the operator who generated the comparison data may provide the security number may to the visitor in advance through a separate e-mail or through a telephone contact.

The entry/exit evaluating portion 22 of the entry/exit controlling device 20, in response to the evaluation request from the reader 31, decrypts the encrypted personal information in the comparison data reported in the evaluation request (Step 120) and checks the validity of the comparison data by obtaining the period of validity that is included within the comparison data that has been obtained and comparing to the current date and time (Step 121).

If, at this point, the current date and time is outside of the period of validity so that the validity of the comparison data cannot be confirmed, the entry/exit evaluating portion 22 reports an evaluation error to the reader 31, and, in response, the reader 31 executes an error process, such as displaying an entry/exit denial.

Moreover, the entry/exit evaluating portion 22 obtains the security number included in the comparison data that has been obtained, and compares it to the security number inputted by the visitor, reported in the evaluation request, to check the validity of the comparison data and the visitor (Step 121).

If, at this point, the two security numbers do not match, so that the validity of the comparison data and the visitor cannot be confirmed, the entry/exit evaluating portion 22 reports an evaluation error to the reader 31, and, in response, the reader 31 executes an error process, such as displaying an entry/exit denial.

On the other hand, if the current date and time is within the period of validity so that the validity of the comparison data is confirmed, the entry/exit evaluating portion 22 not only obtains, from the entry/exit evaluation information of the storing portion 21, entry/exit authorization information corresponding to the shared code obtained from the comparison data, but also obtains, from the region information of the storing portion 21, the region authorization level corresponding to the reader ID of the reader 31 that was reported in the evaluation request, to evaluate the entry/exit authorization, for the region, through comparing the region authorization level and the authorization level of the entry/exit authorization information that have been obtained (Step 122).

If, at this point, the level value of the authorization level of the entry/exit authorization information is lower than the level value of the region authorization level so that the evaluation is an entry/exit denial, the entry/exit evaluating portion 22 reports an evaluation error to the reader 31, and, in response, the reader 31 executes an error process, such as displaying an entry/exit denial.

On the other hand, if the level value of the authorization level of the entry/exit authorization information is equal to or greater than the level value of the region authorization level so that the evaluation is that entry/exit is authorized (Step 102: YES), the entry/exit evaluating portion 22 sends a gate-open instruction to the gate device 32 of the region S through the control bus BS (Step 123). In response, the gate device 32 opens the gate that is provided at the entry/exit of the region S (Step 124). This makes it possible for the visitor to enter into the meeting room that is the region S.

Thereafter, the history controlling portion 23 obtains, from the entry/exit evaluating portion 22, the personal information of the visitor, which is included in the comparison data, along with the processing detail used in the entry/exit evaluation, indicating the evaluation date and time, the shared code, the region, and the type, and stores these as historical information in the storing portion 21 (Step 125).

In this way, in the present example, when the comparison data is generated by the comparison data generating portion 12 of the comparison data generating terminal 10, an arbitrary security number is added to the comparison data, and at the time of the entry/exit authorization evaluation by the entry/exit evaluating portion 22 of the entry/exit controlling device 20, the match between the security number inputted through an operation at the reader 31 and the security number included in the comparison data is checked, making it possible to check the validity of the comparison data and the visitor.

This makes it possible to detect reliably the improper behavior when a third-party has obtained comparison data and attempts entry/exit, making it possible to obtain a high level of security.

While the present example was explained above in reference to examples, the present invention is not limited by the example set forth above. The structures and details of the present invention may be modified in a variety of ways, as can be understood by those skilled in the art, within the scope of the present invention.

The invention claimed is:

1. An entry/exit controlling system, comprising:

a comparison data generating terminal comprising:

a comparison data storing portion storing in advance one or more shared codes shared between a plurality of visitors as information used in entry/exit authorization evaluations, each of the one or more shared codes including an authorization level that indicates one or more regions within a building where a visitor using that shared code is authorized to enter/exit; and a comparison data generating portion generating comparison data including one of the one or more shared codes and personal information of a visitor of the plurality of visitors, the comparison data being required when the visitor enters/exits a region of the one or more regions within the building wherein entry/exit is controlled;

wherein the comparison data is recorded in a recording medium;

an entry/exit controlling device comprising:

an entry/exit storing portion storing in advance entry/exit evaluation information in which the authorization level, as entry/exit authorization information indicating entry/exit-authorized regions for each of the one or more shared codes, is recorded, and storing region information indicating readers provided at each of the one or more regions and a region authorization level of entry/exit at each of the one or more regions; and an entry/exit evaluating portion evaluating entry/exit authorization of the visitor of the plurality of visitors at a region of the one or more regions, and controlling entry/exit of the visitor at the region of the one or more regions; and an entry/exit history storing portion recording, in the entry/exit storing portion of the entry/exit controlling device, processing details of the entry/exit authorization evaluations and the personal information of the visitor of the plurality of visitors, that is included in the comparison data, the processing details and the personal information of the visitor of the plurality of visitors being recorded as historical information, wherein the entry/exit evaluating portion:

obtains the authorization level from the entry/exit evaluation information stored in the entry/exit storing portion, the authorization level corresponding to the shared code included in the comparison data being obtained from the recording medium, upon which the comparison data of the visitor of the plurality of visitors is recorded by a reader disposed at the region of the one or more regions, obtains the region authorization level, which corresponds to the reader, from the region information stored in the entry/exit storing portion, and evaluates the entry/exit authorization of the visitor of the plurality of visitors at the region of the one or more regions through comparing authorization level of the shared code, which is included in the comparison data, to the region authorization level of the reader, without using the personal information of the visitor of the plurality of visitors in the entry/exit authorization evaluation, and the entry/exit evaluation portion controls entry/exit of the visitor of the plurality of visitors at the region of the one or more regions based on an evaluation result of the entry/exit authorization evaluation and where entry/exit is permitted only if the entry/exit authorization of the visitor of the plurality of visitors is equal to, or greater than, the region authorization level of the reader.

2. The entry/exit controlling system as set forth in claim 1, wherein:

the comparison data generating portion adds to the comparison data a period of validity of the comparison data when generating the comparison data; and the entry/exit evaluating portion checks the validity of the comparison data based on the period of the validity included in the comparison data when performing the entry/exit authorization evaluation.

3. The entry/exit controlling system as set forth in claim 1, wherein:

the comparison data generating portion adds to the comparison data an arbitrary security number when generating the comparison data; and the entry/exit evaluating portion checks a match between a security number inputted through a reader operation and the security number included in the comparison data at the time of the entry/exit authorization evaluation.

4. The entry/exit controlling system as set forth in claim 1, wherein:

the comparison data generating portion encrypts a portion or all of the comparison data; and the entry/exit evaluating portion decrypts the portion or all of the comparison data that is encrypted.

5. The entry/exit controlling system as set forth in claim 1, wherein:

the comparison data generating portion sends the generated comparison data via electronic mail to a mobile terminal of the visitor, which is the recording medium; and the reader obtains comparison data that has been sent via electronic mail and displayed on the screen of the mobile terminal or comparison data that has been sent via near field communication from the mobile terminal.

6. The entry/exit controlling system as set forth in claim 1, wherein: the reader obtains comparison data that is printed out on the recording medium.

7. An entry/exit controlling method, comprising:

a shared codes storing step of storing in advance, at a storing portion of a comparison data generating terminal, one or more shared codes shared between a plurality of visitors as information used in entry/exit authorization evaluations, each shared code of the one or more shared codes including an authorization level that indicates one or more regions within a building where a visitor of the plurality of visitors are authorized to enter/exit using each shared code;

a comparison data generating step generating comparison data, at a comparison data generating portion of the comparison data generating terminal, the comparison data including a shared code of the one or more shared codes and personal information of the visitor of the plurality of visitors, required when a visitor enters/exits a region of the one or more regions within the building wherein entry/exit is controlled;

a recording step of recording the comparison data in a recording medium;

an entry/exit evaluation information storing step of storing in advance, at a storing portion of an entry/exit controlling device, entry/exit evaluation information in which the authorization level, as entry/exit authorization information indicating entry/exit-authorized regions for each of the one or more shared codes is recorded, and storing in advance region information indicating readers provided at each of the one or more regions and a region authorization level of entry/exit at each of the one or more regions;

an entry/exit evaluating step of evaluating, at an entry/exit evaluating portion of the entry/exit controlling device, entry/exit authorization of the visitor of the plurality of visitors at a region of the one or more regions;

an entry/exit controlling step of controlling, at an entry/exit evaluating portion of the entry/exit controlling device, entry/exit of the visitor of the plurality of visitors at the region of the one or more regions; and a history controlling step of recording, in the storing portion of the entry/exit controlling device records, processing details of the entry/exit authorization evaluations and the personal information of the visitor of the plurality of visitors that is included in the comparison data, the processing details and the personal information of the visitor of the plurality of visitors being recorded as historical information, wherein, in the entry/exit evaluating step, the entry/exit evaluating portion obtains the authorization level from the entry/exit evaluation information stored in the storing portion of the entry/exit controlling device, the authorization level corresponding to the shared code included in the comparison data being obtained from the recording medium upon which the comparison data of the visitor of the plurality of visitors is recorded, by a reader disposed at the region of the one or more regions, obtains the region authorization level, which corresponds to the reader, from the region information stored in the storing portion of the entry/exit controlling device, and evaluates the entry/exit authorization of the visitor of the plurality of visitors at the region of the one or more regions through comparing the authorization level of the shared code, which is included in the comparison data, to the region authorization level of the reader, without using the personal information of the visitor of the plurality of visitors in the entry/exit authorization evaluation, and in the entry/exit controlling step, the entry/exit evaluating portion controls entry/exit of the visitor of the plurality of visitors at the region of the one or more regions based on an evaluation result of the entry/exit authorization evaluation and where entry/exit is permitted only if the entry/exit authorization of the visitor of the plurality of visitors is equal to, or greater than, the region authorization level of the reader.

* * * * *